United States Patent [19]

Cruickshank

[11] 4,190,907

[45] Mar. 4, 1980

[54] TERRY HAIR DRIER

[76] Inventor: Ann M. Cruickshank, 6978 Maplewood Rd., Parma Heights, Ohio 44130

[21] Appl. No.: 912,019

[22] Filed: Jun. 2, 1978

[51] Int. Cl.[2] ..... A42B 1/04

[52] U.S. Cl. ..... 2/202

[58] Field of Search ..... 2/201, 202, 198, 205, 2/DIG. 2; 132/9; 34/95, 96

[56] References Cited

U.S. PATENT DOCUMENTS

| | | | |
|---|---|---|---|
| 344,368 | 6/1886 | Freschel | 2/201 |
| 1,547,140 | 7/1925 | Weinstein | 2/201 X |
| 2,038,398 | 4/1936 | Wengen | 2/201 |
| 2,069,020 | 1/1937 | Schuessler | 2/201 |
| 2,263,418 | 11/1941 | Ganim | 2/198 |
| 3,187,345 | 6/1965 | Holford | 2/DIG. 2 |
| 3,246,340 | 4/1966 | Bonk et al. | 2/201 |

FOREIGN PATENT DOCUMENTS

| | | | |
|---|---|---|---|
| 335805 | 10/1930 | United Kingdom | 2/201 |

*Primary Examiner*—H. Hampton Hunter

*Attorney, Agent, or Firm*—Edward A. Hayman; D. Peter Hochberg

[57] ABSTRACT

A caplike head covering for placing over the hair immediately after washing or otherwise wetting the hair is made from absorbent material adapted to readily control liquids dripping from the hair. A piece of an absorbent, foldable, sheet material is formed into a tube closed at the ends. One of the closed ends is pushed axially inwardly of the tube toward the other closed end, whereby the tubular piece is folded inwardly upon itself to provide a double-walled, absorbent headpiece.

4 Claims, 6 Drawing Figures

TERRY HAIR DRIER

BACKGROUND OF THE INVENTION

This invention relates to a cap or bonnet adapted to be placed upon and envelop the head immediately after washing or otherwise applying a liquid to the hair for drying the hair and keeping it manageable. Articles covering or wrapping the head for drying purposes are well-known and generally comprise either an especially-formed piece of towelling to aid in forming a protective turban, or a hood or bonnet for placing over the hair. It is also known to provide a hair-drying means comprising inner and outer walls having a special drying agent, such as silica gel, disposed between the walls. A hood or bonnet provided with loops and ties whereby an absorbent material can be neatly arranged close to the head of the wearer has been disclosed.

The hair drying and controlling means of the prior art is generally complicated both from the standpoint of manufacture and use. They involve complicated and highly specialized shapes requiring the head to be wrapped or encased in a special manner which is time-consuming and can also be prohibitively strenuous for some persons, such as the elderly or those suffering from arthritis. The addition of special drying agents, such as silica gel, adds to the expense of the article and makes it impractical for everyday use for the average person in his own home.

SUMMARY OF THE INVENTION

The present invention comprises a cap or headpiece formed by making a tube of an absorbent, foldable, sheet material such as terry cloth, providing means closing the ends of the tube, and then folding one end of the tube inwardly toward the other end to provide a double-walled cap or bonnet which can be quickly and easily pulled over wet hair to contain and control the hair while absorbing the liquid and beginning the drying process. The cap requires no special skill or manipulation to put on, and it can be quickly and easily reversed whereby a relatively drier outer wall is applied to the wet hair.

It is the inventor's objective to provide a hair drying headpiece which is easy to apply immediately after washing or otherwise saturating the hair with a liquid, and will immediately allow the wearer to attend to other matters of grooming, unencumbered by wet, dripping hair. An additional object is to provide a headpiece of the type referred to which is easy to launder and, in the unfolded condition, presents all of its outer surface portions to the ambient air for quick drying. A further object of this invention is to provide a headpiece as set forth above which is simple and easy to construct, inexpensive, and durable in use.

DESCRIPTION OF THE DRAWINGS the object of the invention and the many advantages thereof will be readily understood from the description thereof, referring to the accompanying drawings in which.

DESCRIPTION OF THE PREFERRED EMBODIMENT

Figure 1:
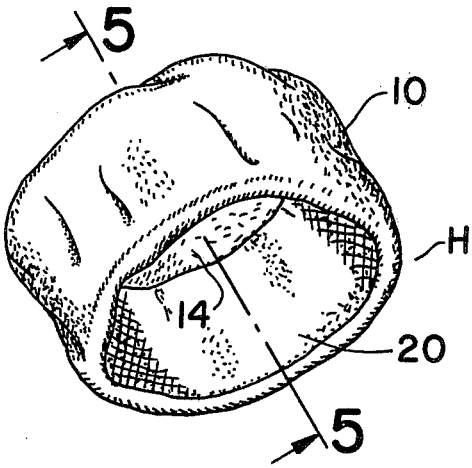
FIG. 1 is a perspective view of the terry hair drier headpiece of this invention.

The following description of a preferred embodiment of the invention refers to the above-described drawings in which corresponding elements in the different figures of the drawings are identified by corresponding numerals or other graphic symbols.

In the drawings, the headpiece is generally designated by the letter H. The invention is best understood by first referring to FIGS. 2 and 3, wherein the numeral 10 designates a body portion comprising a generally rectangular piece of absorbent material such as terry cloth. In the form of the invention disclosed, the rectangular piece of material is formed into a tube by sewing opposite end edges 11 and 12 to end closures 13 and 14, respectively. Said end closures are also made from an absorbent material such as terry cloth and are of such shape as to determine a preferred cross-sectional shape to the tube. In their simplest form, end closures 13 and 14 would be circular and of substantially the same size whereby the finished headpiece H would provide a circular opening as will hereinlater be fully understood. However, since said end closures do determine the shape of the opening of the final headpiece, they may obviously by contoured in any manner to provide the best fit for the wearer.

Figure 2:
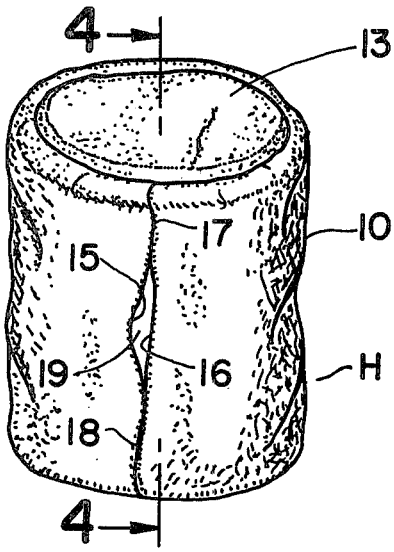
FIG. 2 illustrates a perspective view of the headpiece in its axially extended or unfolded condition.
Figure 3:
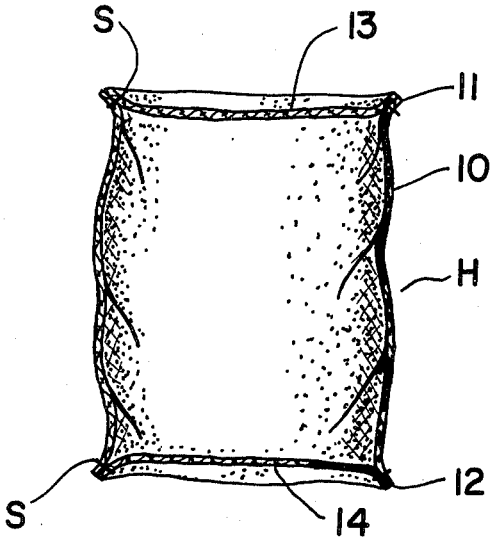
FIG. 3 is a longitudinal section through the headpiece showing a first stage of construction.

The end closures 13 and 14 are sewed, as indicated at S, or otherwise suitably secured to the end edges 11 and 12, respectively, of the body 10. Said body is of sufficient width that it can be attached around the entire circumferences of the end closures 13 and 14, whereby side edges 15 and 16 of the body 10 overlap. As shown in FIG. 3, the body 10 and end closures 13 and 14 are simply sewed together at overlapping edge portions whereby to initially form the tube of cloth in what is commonly referred to as the wrong-side-out condition. At this point in construction, it is preferred that the side edges 15 and 16 be similarly sewed together over a substantial distance in the axial direction from the end closures 13 and 14, as indicated at 17 and 18, respectively. As a result, an opening 19 is left between portions of the side edges 15 and 16 by means of which the cloth tube can be turned right-side-out by reaching through the opening and pulling the entire cloth, including body portion and both end closures, through said opening. FIG. 2 illustrates the headpiece H just after it has been turned right-side-out, and prior to final closing of the opening 19, preferably by a blind stitch. In this right-side-out condition, the sewing S is disposed inside the tubular body 10.

Figure 4:
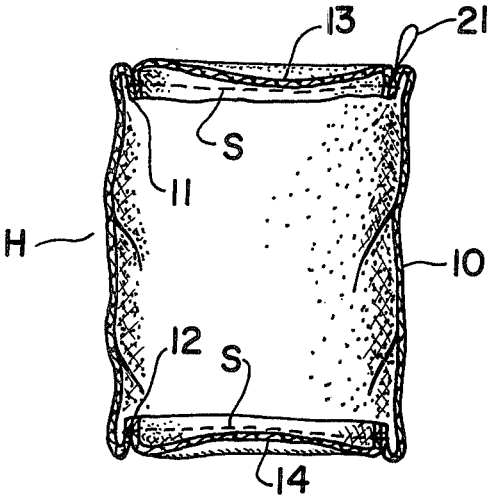
FIG. 4 is a longitudinal section taken along the line 4—4 of FIG. 2.
Figure 5:
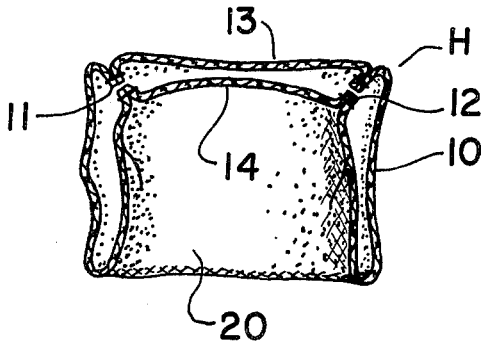
FIG. 5 is a section taken along the line 5—5 of FIG. 1.
Figure 6:
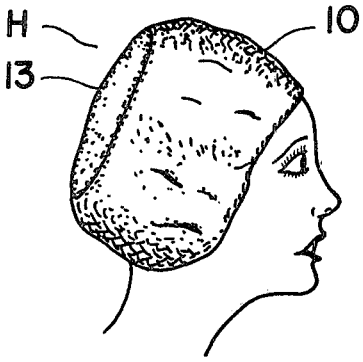
FIG. 6 is a view showing the headpiece of this invention as it is worn by a user.

As shown in the section view of FIG. 5, the tubular body 10 is next folded inwardly upon itself whereby, for example, the end closure 14 is pushed axially inwardly of the body to lie adjacent to the end closure 13. This forms a head opening 20, the transverse shape of which is obviously determined by the initial shape of the end closures 13 and 14. The axial dimension of the body portion 10 as shown in FIGS. 2–4 is at least twice the desired depth of the finished headpiece, whereby folding one end thereof inwardly will result in an opening of the desired size. It is contemplated that the headpiece H could be made in various sizes, although this particular construction combined with the use of terry cloth makes the finished headpiece substantially universally adaptable to different-sized heads.

In use, the headpiece H is preferably simply pulled over the hair after rinsing or otherwise wetting the hair. A person with especially long hair may want to first pile the hair on top of the head and then pull the headpiece into place. The absorbent material envelops the head and immediately begins drying the hair and controlling the dripping water, thereby leaving the user with both hands free. The hair is completely controlled, and the headpiece may be worn as long as desired. It will be readily appreciated that the headpiece can be reversed at any time by folding it inwardly from the opposite end, and again placed upon the head whereby the drier outer layer of absorbent cloth is placed against the hair. The depth or axial dimension of the head opening 20 can be easily adjusted by, for example, folding the end closure 14 inwardly either against the opposite end closure 13 or spaced a determined distance therefrom. Placing the end closure 14 against the closure 13 provides the deepest head opening, and keeping said end closures apart provides a relatively shallower head opening. Thus the headpiece can be pulled downwardly over the head to any extent desired.

When the wearer is ready to remove the headpiece H, it can be easily returned to the tubular condition shown in FIGS. 2 and 4, whereby all of the cloth has a surface portion disposed outwardly for more rapid drying. If desired, a small loop or strap 21 may be incorporated in the sewing of one of the end closures 13 or 14, as illustrated in FIG. 4, or otherwise secured to the headpiece, to adapt the headpiece for hanging on a hook adjacent to a shower or on a clothesline.

The headpiece H of the invention may be of any suitable size. One generally suitable example comprises a tubular body 10 approximately 12" (30.48 cm) in length having end closures 13 and 14 substantially 6-¼" (15.875 cm) in diameter. Obviously, other dimensions may be used where desired.

It is contemplated that the tubular body portion 10 may not necessarily be of uniform diameter or cross section along the axial length thereof. In the following claims, the term "tubular" means a body portion comprising a substantially continuous skirt or wall affording a hollow body having end portions adapted for closing by some means.

Although I have described a preferred embodiment of my invention, obvious changes may be made which are still within the spirit of the invention and the scope of the following claims.

I claim:

1. A hair dryer headpiece comprising a tubular body portion formed of an absorbent, foldable, sheet material and having end edge portions at either end; a pair of end closures made of absorbent, foldable, sheet material; said end closures having circumferential portions equal in length to said end edge portions, an end closure being sewed at said circumferential portions to said end edge portions at each said end of said body portion whereby said tubular body portion is closed at the ends; said tubular body portion being folded inwardly upon itself from either end in use thereof whereby one of said end closures is disposed within said body portion adjacent to the inside of the opposite end closure to provide a double-walled, absorbent headpiece for enveloping the head and controlling wet hair and whereby said headpiece can readily be reversed by folding said body portion inwardly from the opposite direction to turn the outer, dryer material inwardly toward the head.

2. A hair drier headpiece as set forth in claim 4 wherein said body portion is unfoldable whereby the closed ends are separated and said body portion is extended its full axial length to facilitate drying thereof.

3. A hair drier headpiece as set forth in claim 2 wherein said headpiece is made entirely of terry cloth.

4. A hair dryer headpiece as set forth in claim 3 wherein said tubular body portion is formed from a generally rectangular piece of terry cloth and said end closures are circular.

* * * * *

UNITED STATES PATENT AND TRADEMARK OFFICE

CERTIFICATE OF CORRECTION

PATENT NO. : 4,190,907

DATED : March 4, 1980

INVENTOR(S) : Ann M. Cruickshank

It is certified that error appears in the above-identified patent and that said Letters Patent are hereby corrected as shown below:

Column 1, line 59, "the" first occurrence should read --The--. Column 3, line 36, "the" second occurrence should read --this--. Column 4, line 31, "4" should read --1--.

Signed and Sealed this

*Twenty-second* Day of *July 1980*

[SEAL]

*Attest:*

SIDNEY A. DIAMOND

*Attesting Officer*

*Commissioner of Patents and Trademarks*